US007401489B2

(12) United States Patent
Wing

(10) Patent No.: US 7,401,489 B2
(45) Date of Patent: Jul. 22, 2008

(54) METHOD OF FORMING A ONE-PIECE FRAME FOR A CANTILEVERED REFRIGERATOR SHELF

(75) Inventor: Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/390,385

(22) Filed: Mar. 28, 2006

(65) Prior Publication Data

US 2007/0227222 A1 Oct. 4, 2007

(51) Int. Cl.
*A47F 5/08* (2006.01)

(52) U.S. Cl. ..... 72/379.2; 72/379.4; 211/153; 211/90.01; 248/235

(58) Field of Classification Search ..... 72/379.2, 72/379.4; 312/401–408; 211/153; 248/242, 248/243, 250; 29/505
See application file for complete search history.

(56) References Cited

U.S. PATENT DOCUMENTS 3,037,267 A * 6/1962 Kimball et al. ..... 29/897.15
3,952,574 A * 4/1976 Speidel ..... 72/379.2
4,861,123 A * 8/1989 Russell ..... 312/330.1
5,228,764 A * 7/1993 Cherry et al. ..... 312/408
5,269,602 A * 12/1993 Kuwahara et al. ..... 312/406.2
5,403,083 A 4/1995 Dasher et al.
5,484,196 A 1/1996 Kim
6,105,233 A 8/2000 Neal
6,220,461 B1 4/2001 Dickinson
6,516,507 B2 2/2003 Noel et al.
6,609,285 B1 * 8/2003 Kinney ..... 29/407.05
6,786,562 B2 * 9/2004 Obrock et al. ..... 312/408
2003/0020387 A1 1/2003 Wing et al.

FOREIGN PATENT DOCUMENTS

DE 4216448 12/1992
GB 2209272 5/1989

* cited by examiner

*Primary Examiner*—Dmitry Suhol
(74) *Attorney, Agent, or Firm*—Kirk Goodwin; Michael D. Lafrenz

(57) ABSTRACT

A one-piece frame for a refrigerator shelf is produced from a planar blank having first and second side members that extend at an angle from a central cross member. The side members are folded along bend zones located between each of the first and second side members and the cross member such that, once folded, the first and second side members extend outward from the cross member forming a three-sided frame. At this point, edge portions of the first and second side members are folded along additional bend zones to form upper flanges. Preferably, an upper edge portion of the cross member is folded along still another bend zone to form a hook element. The hook element is designed to engage with a shelf support member provided in the refrigerated compartment such that the shelf frame is supported in a cantilevered manner.

10 Claims, 4 Drawing Sheets

METHOD OF FORMING A ONE-PIECE FRAME FOR A CANTILEVERED REFRIGERATOR SHELF

BACKGROUND OF THE INVENTION

1. Field of the Invention

The present invention pertains to the art of refrigerators and, more particularly, to a method of forming a one-piece frame for a cantilevered refrigerator shelf.

2. Discussion of the Prior Art

Cantilevered shelves, i.e., a shelf that is suspended from only one edge, have been employed for some time in the art of refrigerators. A traditional cantilevered shelf generally includes a frame having one or more hooks that are inserted into slots formed in a support bracket to functionally mount the shelf in a refrigerated compartment. Such shelves generally include steel frames, which present certain challenges during a manufacturing process. Often times, the manufacturing process requires joining, through a welding process, individual pieces to form a shelf frame. Welding processes are generally costly, create structural weak points and produce a product having unsightly or uneven edges and seams that require additional finishing steps.

It is also known to construct shelving from a single sheet of bendable material, such as hot rolled steel. However, in a typical refrigerated appliance, the shelving is not formed entirely from steel but, at best, includes a steel frame to which is often times fitted a glass top. Thus, despite the existence of cantilevered shelves in the prior art, there still exists a need for a method of forming a shelf frame for a cantilevered shelf for use in refrigerators. More specifically, there exists a need for a method of forming a cantilevered refrigerator shelf frame by folding a single member into a three sided frame structure that is subsequently fitted with a shelf element.

SUMMARY OF THE INVENTION

The present invention is directed to a method of forming a one-piece frame for a refrigerator shelf. The one-piece frame is produced from a planar blank having first and second side members that extend at an angle from a central cross member. The side members are folded along bend zones located between each of the first and second side members and the cross member such that, once folded, the first and second side members extend outward from the cross member. At this point, edge portions of the first and second side members are folded along additional bend zones to form reinforcing flanges. Finally, an edge portion of the cross member is folded along still another bend zone to form a hook element. The hook element is designed to engage with a shelf support member provided in a compartment of a refrigerator such that the shelf frame is supported in a cantilevered manner.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
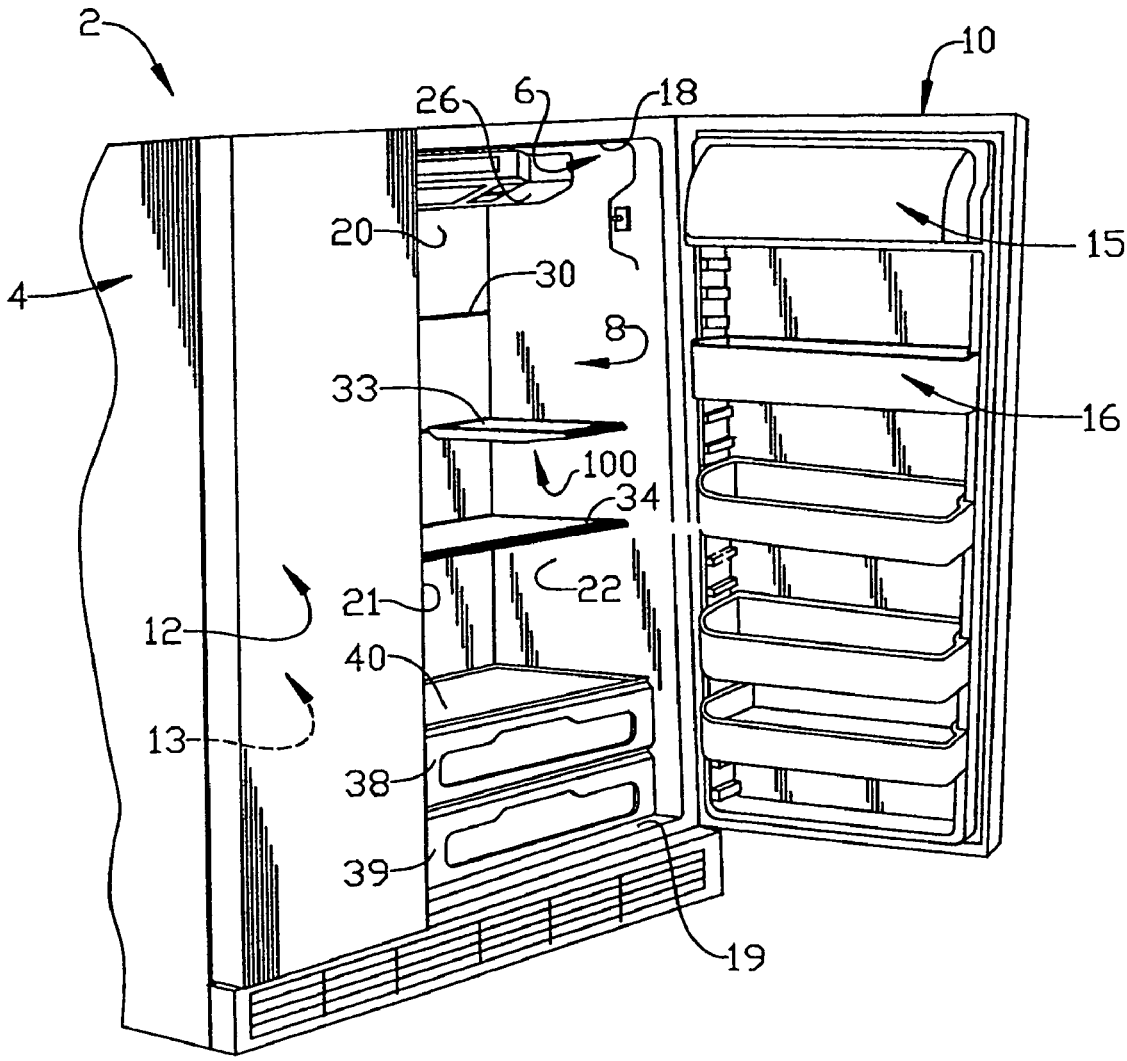
FIG. 1 is a right perspective view of a side-by-side refrigerator incorporating a one-piece shelf frame constructed in accordance with the method of present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. For the sake of completeness, door 10 of refrigerator 2 is shown to include a dairy compartment 15 positioned above various vertically adjustable shelving units or bins, one of which is indicated at 16.

As shown, fresh food compartment 8 is defined, at least in part, by top, bottom, rear and opposing side walls 18-22. Mounted in an upper region of fresh food compartment 8 is a temperature control housing 26 including a plurality of temperature control elements and a light (not separately labeled). Also shown in FIG. 1, a plurality of shelf support rails, one of which is indicated at 30, extends laterally across rear wall 20 of fresh food compartment 8. As will be discussed more fully below, shelf support rail 30 constitutes mounting structure for a plurality of vertically spaced shelves, two of which are shown at 33 and 34. Finally, at a lowermost portion of fresh food compartment 8 is illustrated a pair of bins 38 and 39, with bin 38 being positioned below a lower stationary shelf 40. To this point, the above-described structure is known in the art and presented only for the sake of completeness and to enable a better understanding of the drawings. Instead, the present invention is directed to a method of forming a one-piece shelf frame 100 which is preferably employed in the formation of shelves 33, 34 and configured to be cantilevered from a selected shelf rail 30.

Reference will now be made to FIGS. 2-5 in describing shelf frame 100. With initial reference to FIG. 2, shelf frame 100 is initially formed as a frame blank 104 having a first side member 106, a second side member 110 and a cross member 114. As shown, first side member 106 includes a first end 116, a second end 117 and an intermediate portion 118. Second side member also includes a first end 121, a second end 122 and an intermediate portion 123. Each side frame member 106, 110 defines corresponding upper and lower outer edge portions 126, 127 and 129, 130 respectively. Similarly, cross member 114 includes a first end 140 that extends to a second end 141 through an intermediate portion 142. Cross member 114 also includes upper and lower outer edge portions 146 and 147. Frame blank 104 is preferably formed through a stamping process. Regardless, in accordance with the invention, the entire frame blank 104 is made from a single sheet of material, preferably steel.

More specifically, in accordance with the invention, first end 116 of side member 106 extends from first end 140 of cross member 114 at a first bend zone 154. Likewise, first end 121 of second side member 110 extends from second end 141 of cross member 114 at a second bend zone 155. In further accordance with the invention, first and second side members 106 and 110 extend from cross member 114 at an angle which, in a manner that will be discussed more fully below, establishes an angle for cross member 114 after shelf frame 100 is formed. In addition to first and second bend zones 140 and 141, a third bend zone 158 extends longitudinally along first side member 106 below upper outer edge portion 126. Likewise, a fourth bend zone 159 extends longitudinally along second side member 110 below upper outer edge portion 129. A fifth bend zone 164 extends along cross member 114 below upper outer edge portion 146. Finally, blank 104 is shown to include a plurality of mounting apertures 170-175 which are employed to secure a shelf top (not shown) and a transverse support element to shelf frame 100 upon completion of a forming process. The particular type of shelf top can vary in accordance with the present invention and can include, for example, a glass top, simple plastic tops, sliding tops and the like. As will be readily apparent from the further description below, mounting apertures 170-175 can be formed during the initial stamping process or subsequent thereto.

Figure 2:
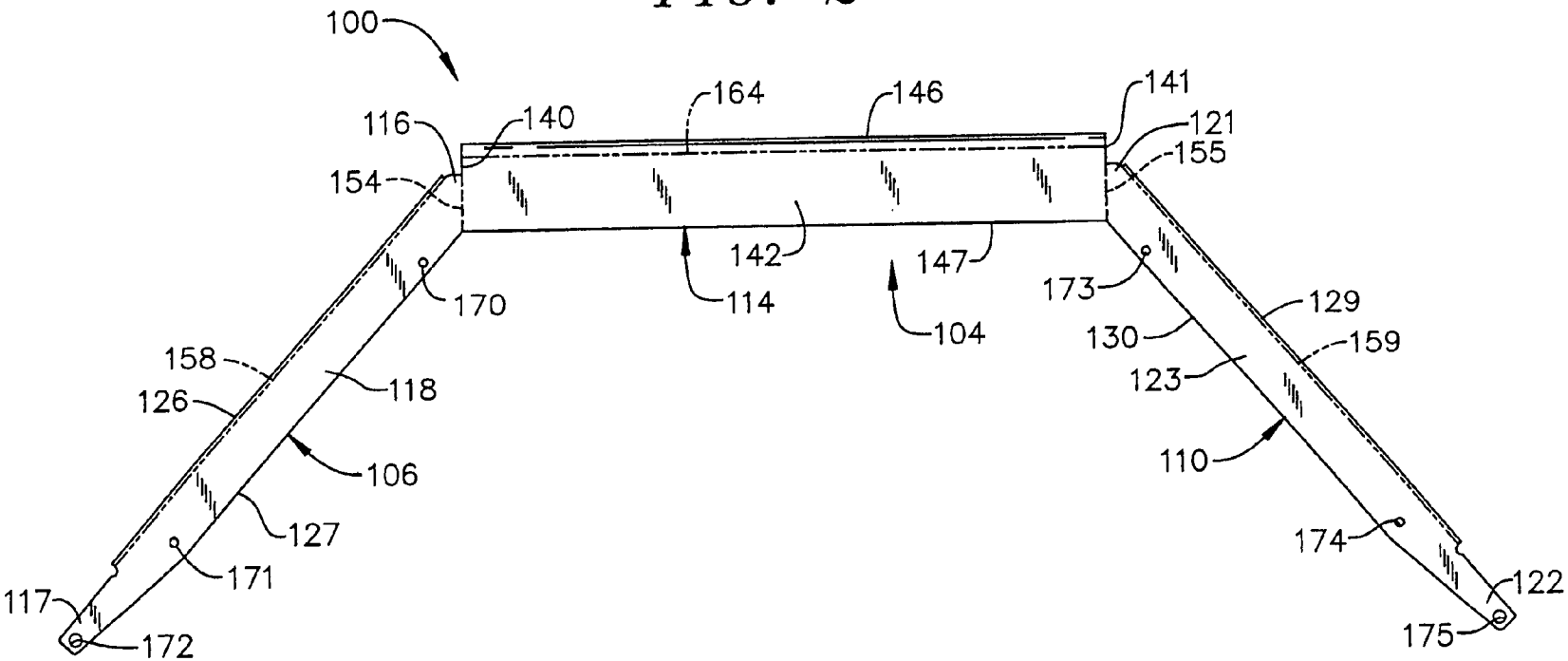
FIG. 2 is a front elevational view of a one-piece shelf frame blank.
Figure 3:
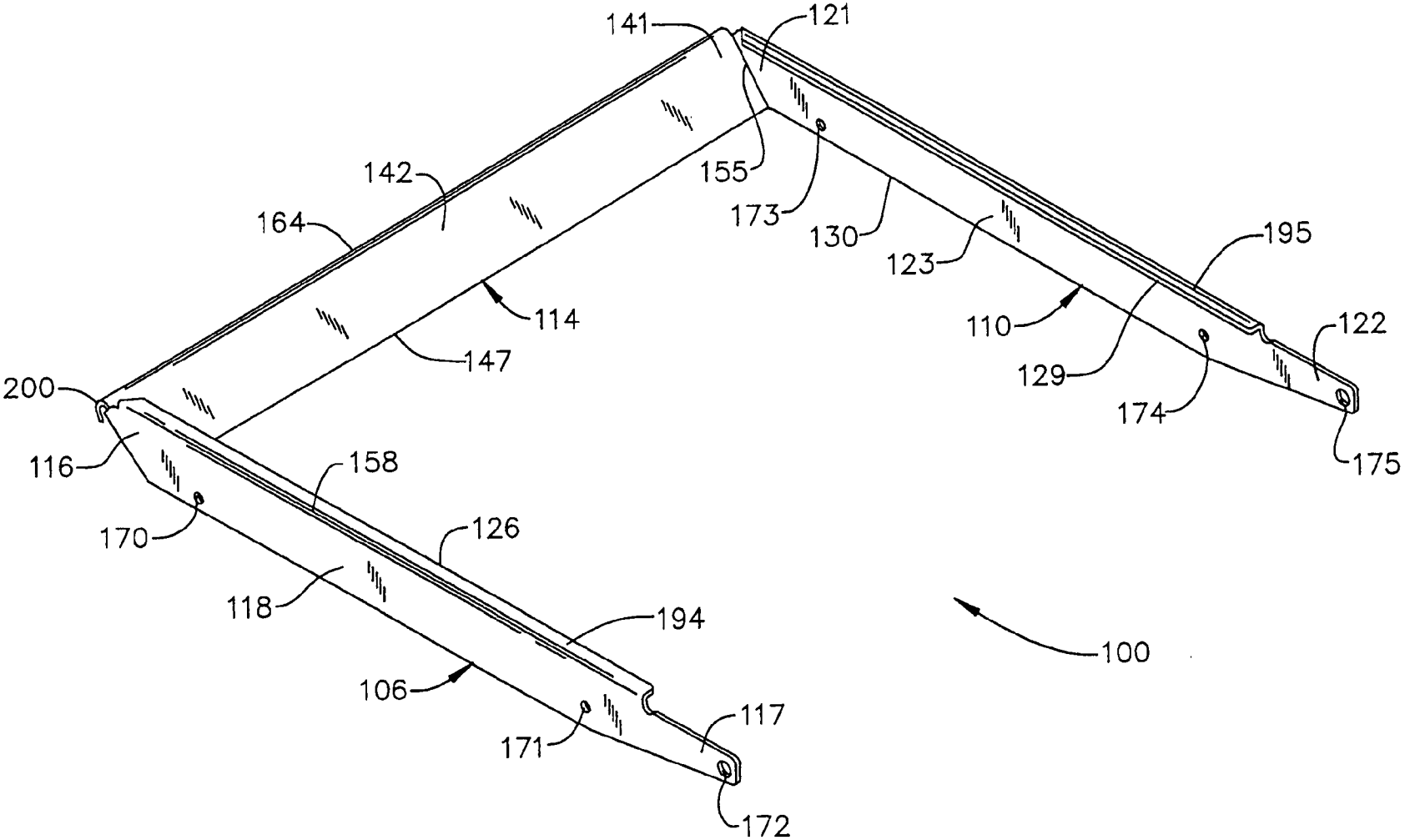
FIG. 3 is an upper right perspective view of a one-piece shelf frame formed from the frame blank of FIG. 2.
Figure 5:
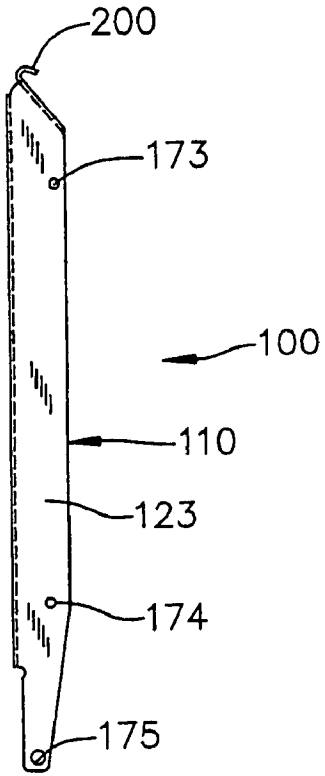
FIG. 5 is a left side elevational view of the one-piece shelf frame of FIG. 3.
Figure 4:
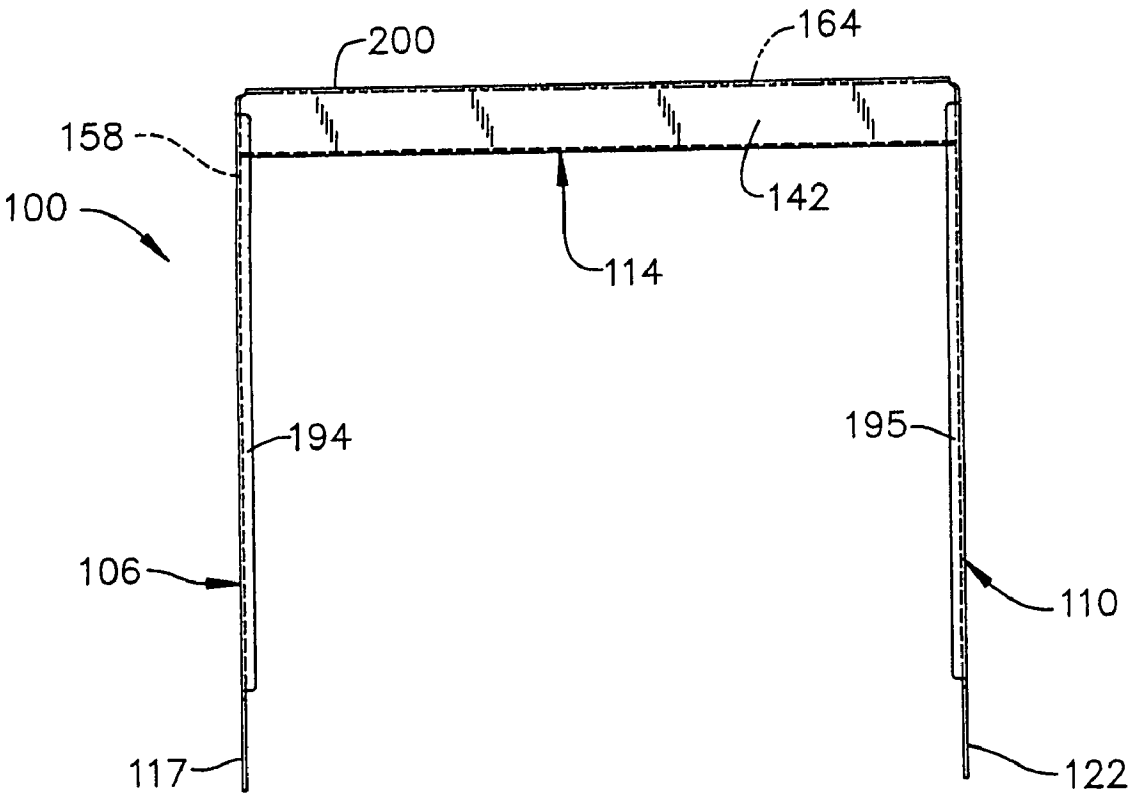
FIG. 4 is a top plan view of the one-piece shelf frame of FIG. 3.

Based on the above description, it should be readily apparent that FIG. 2 illustrates frame blank 104 laid substantially flat. In accordance with the most preferred form of the invention, after forming frame blank 104, side members 106 and 110 are folded along first and second bend zones 154 and 155 so as to extend outward from cross member 114 to form a three-sided frame as represented in FIG. 3. Side members 106 and 110 are folded so as to extend substantially parallel to one another, thereby establishing an angle in cross member 114 relative to upper and lower outer edge portions 126, 127 and 129, 130 respectively as best shown in FIGS. 3 and 5.

After folding first and second side members 106 and 110, upper outer edge portions 126 and 129 are folded inward along third and fourth bend zones 158 and 159 respectively, to form first and second upper reinforcing flanges 194 and 195. Finally, upper outer edge 146 of cross member 114 is folded along fifth bend zone 164 to form a hook 200. Hook 200 is designed to engage with shelf support rail 30 so as to hang shelf frame 100 in a cantilevered manner. In any event, once shelf frame 100 is formed, as set forth above, a shelf top can be mounted to side members 106 and 110 and secured with various fasteners through apertures 170, 171, 173 and 174 with apertures 172 and 175 preferably being provided to accept a rigid transverse cross bar (not shown) to connect first and second side members 106, 100 of second end portions 117 and 122.

Based on the above, it should be realized that the present invention provides for a simple, cost effective means of creating a one-piece shelf frame for a cantilevered refrigerator shelf that can be easily adapted to a wide variety of refrigerator models depending upon the particular shelf top employed and the configuration established for hook 200. It should also be realized that the overall width of shelf frame 100 can be varied such that the final shelf could be either a side-sliding shelf or a vertically adjustable, full width shelf. Finally, it should be understood that, while the preferred method described above outlined folding the support arm prior to forming the upper flange members and hook, the overall order to the steps can be varied. Therefore, although described with reference to a preferred embodiment of the invention, it should be readily understood that various changes and/or modifications can be made to the invention without departing from the spirit thereof. For instance, while described in connection with a side-by-side refrigerator, the present invention can be incorporated into a wide array of refrigerator model, including top mount, bottom mount, and French door style, as well as dedicated freezer and/or refrigerator units. In general, the invention is only intended to be limited by the scope of the following claims.

I claim:

1. A method comprising: forming a refrigerator shelf by:

forming a blank from a sheet of material, said blank including a first side member having upper and lower outer edge portions, a second side member having upper and lower outer edge portions, and a cross-member having upper and lower outer edge portions, each of said first and second side members projecting from the cross member at a non-orthogonal angle;

folding the first side member along a first bend zone so as to project outward from the cross member in a first direction; and folding the second side member along a second bend zone to as to project outward from the cross member in the first direction, said first and second side members being substantially parallel and said cross member being angled relative to the upper and lower outer edge portions of the first and second side members so as to form a three sided frame with an open area between the substantially parallel first and second side members.

2. The method of claim 1, further comprising: folding the upper outer edge portion of the first side member laterally inward along a third bend zone to form a first upper flange.

3. The method of claim 2, wherein the upper outer edge portion of the first side member is folded such that the first upper flange extends at a substantially 90 degree angle to form the first side member.

4. The method of claim 2, further comprising: folding the upper outer edge portion of the second side member laterally inward along a fourth bend zone to form a second upper flange.

5. The method of claim 4, wherein the upper outer edge portion of the second side member is folded at a substantially 90 degree angle to form the second upper reinforcing flange.

6. The method of claim 4, further comprising: folding an upper outer edge portion of the cross member along a fifth bend zone to form a rear hook.

7. The method of claim 1, further comprising: folding an upper outer edge portion of the cross member to form a rear hook.

8. The method of claim 1, further comprising: forming a plurality of spaced mounting apertures in each of the first and second side members.

9. The method of claim 1, wherein the blank is formed through a metal stamping process.

10. A method comprising: forming a refrigerator shelf by:

forming a blank from sheet of material, said blank including a first side member having upper and lower outer edge portions, a second side member having upper and lower outer edge portions, and a cross-member, each of said first and second side members projecting from the cross member at a non-orthogonal angle;

folding the first side member along a first bend zone so as to project outward from the cross member in a first direction;

folding the second side member along a second bend zone to as to project outward from the cross member in the first direction, said first and second side members being substantially parallel and said cross member being angled relative to the upper and lower outer edge portions of the first and second side members so as to form a three sided frame with an open area between the first and second side members; and folding the upper outer edge portion of the first side member laterally inward along a third bend zone to form a first upper flange.

* * * * *